US009703239B1

(12) United States Patent
Shimodaira

(10) Patent No.: US 9,703,239 B1
(45) Date of Patent: Jul. 11, 2017

(54) FIXING DEVICE HAVING A GUIDE MEMBER WITH A RECESSED SHAPE

(71) Applicant: FUJI XEROX CO., LTD., Tokyo (JP)

(72) Inventor: Akira Shimodaira, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/135,887

(22) Filed: Apr. 22, 2016

(30) Foreign Application Priority Data

Dec. 22, 2015 (JP) ..... 2015-249599

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
USPC ..... 399/322
See application file for complete search history.

(56) References Cited

U.S. PATENT DOCUMENTS 7,187,895 B2 * 3/2007 Nakano et al. .... G03G 15/6573 399/322
8,041,277 B2 * 10/2011 Hashimoto et al. ..... G03G 15/2028 399/322
9,026,020 B2 * 5/2015 Chikugo ..... G03G 15/2028 399/322

FOREIGN PATENT DOCUMENTS

JP 2004115266 A 4/2004
JP 2015-102659 A 6/2015

* cited by examiner

*Primary Examiner* — William J Royer
(74) *Attorney, Agent, or Firm* — Oliff PLC

(57) ABSTRACT

A fixing device includes a heater, a heating rotary member, a pressure rotary member, and a guide member. The heating rotary member is rotated while being heated by the heater. The pressure rotary member is in pressure contact with part of an outer circumferential surface of the heating rotary member so as to be rotated and so as to form a pressure contact portion which allows a recording medium to pass therethrough. The guide member has a guide portion which guides a leading end of the recording medium toward part of the outer circumferential surface of the heating rotary member. The guide portion has a guide ending portion having a central portion and left and right end portions in a direction parallel to a rotational axis direction of the heating rotary member. The central portion is recessed relative to the left and right end portions.

5 Claims, 15 Drawing Sheets

FIXING DEVICE HAVING A GUIDE MEMBER WITH A RECESSED SHAPE

CROSS-REFERENCE TO RELATED APPLICATIONS

This application is based on and claims priority under 35 USC 119 from Japanese Patent Application No. 2015-249599 filed Dec. 22, 2015.

BACKGROUND

Technical Field

The present invention relates to a fixing device and an image forming apparatus.

SUMMARY

According to an aspect of the present invention, a fixing device includes a heater, a heating rotary member, a pressure rotary member, and a guide member. The heating rotary member has an outer circumferential surface and is rotated while being heated by the heater. The pressure rotary member is in pressure contact with part of the outer circumferential surface of the heating rotary member extending in an axial direction so as to be rotated and so as to form a pressure contact portion which allows a recording medium having a leading end and lateral end portions and bearing an unfixed image having been transferred thereto to pass therethrough. The guide member has a guide portion which guides the leading end of the recording medium toward part of the outer circumferential surface of the heating rotary member approaching the pressure contact portion and which has a guide ending portion where the guiding performed by the guide portion ends and where a central portion and left and right end portions other than the central portion of the guide ending portion in a direction parallel to a rotational axis direction of the heating rotary member are provided. In the guide member, the central portion has a recessed shape recessed relative to the left and right end portions that guide the lateral end portions of the recording medium while the recording medium is being transported.

BRIEF DESCRIPTION OF THE DRAWINGS

Exemplary embodiments of the present invention will be described in detail based on the following figures, wherein:

FIG. 4A is a plan view of the introduction guide member, and FIG. 4B is a schematic sectional view of the introduction guide member of FIG. 4A taken along line IVB-IVB;

FIG. 5A illustrates a state in which a leading end of a recording sheet fed from the second transfer portion is introduced into a pressure contact portion of the fixing device, and FIG. 5B illustrates a state in which part of the recording sheet on the leading end side is introduced into and passes through the pressure contact portion of the fixing device;

FIG. 7A illustrates a state of part of the recording sheet on a trailing end side when part of the recording sheet on the leading end side is introduced into and passes through the pressure contact portion of the fixing device, and FIG. 7B illustrates a state of part of the recording sheet on the trailing end side that approaches or is brought into contact with and passes through the guide ending portion of the guide portion of the introduction guide member;

FIG. 14A is a plan view of the introduction guide member, and FIG. 14B is a schematic sectional view of the introduction guide member of FIG. 14A taken along line XIVB-XIVB;

FIG. 15A illustrates a state of part of the recording sheet between the pressure contact portion and the introduction guide member when part of the recording sheet on the leading end side is introduced into and passes through the pressure contact portion of the fixing device, and FIG. 15B illustrates a state of part of the recording sheet on the trailing end side of the pressure contact portion.

DETAILED DESCRIPTION

Exemplary embodiments of the present invention (simply referred to as "exemplary embodiments" hereafter) will be described below with reference to the accompanying drawings.

First Exemplary Embodiment

Figure 1:
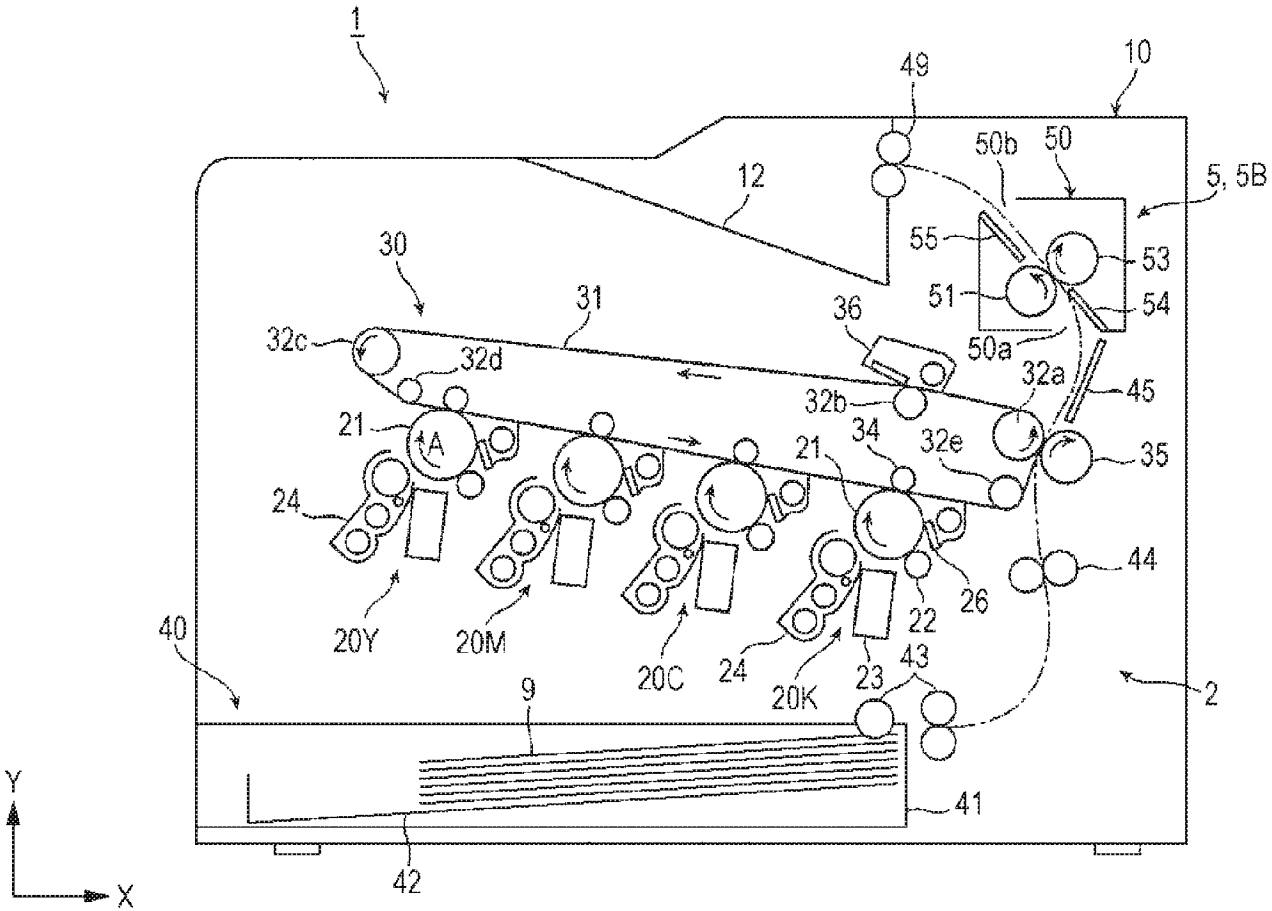
FIG. 1 is a conceptual view of the structure of an image forming apparatus according to a first exemplary embodiment.
Figure 2:
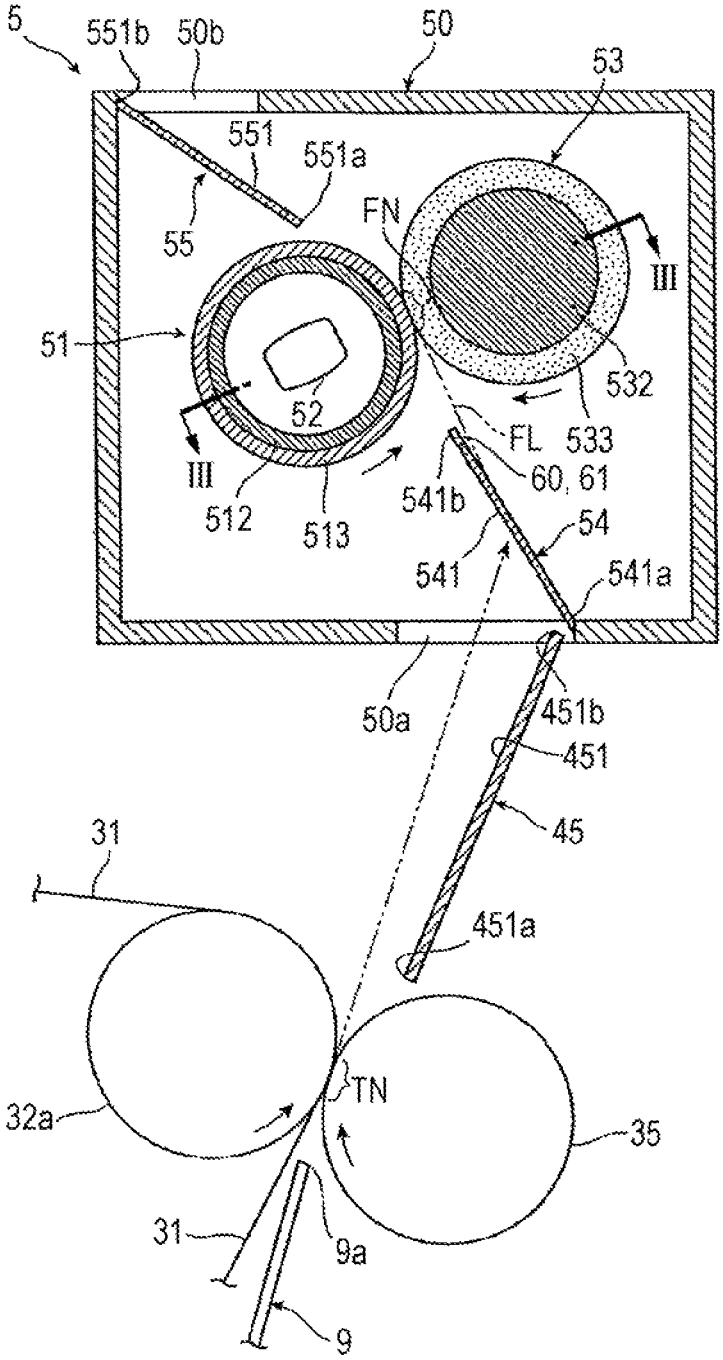
FIG. 2 is an enlarged partially sectional view of parts (fixing device and second transfer portion) of the image forming apparatus of FIG. 1.

FIGS. 1 and 2 illustrate an image forming apparatus that uses a fixing device according to a first exemplary embodiment. FIG. 1 conceptually illustrates an overall structure of the image forming apparatus. FIG. 2 conceptually illustrates parts (fixing device and second transfer portion) of the image forming apparatus. Arrows of the drawings such as FIG. 1 denoted by X, Y, and Z represent (the directions of) the axes of rectangular coordinates indicating the width, height, and depth directions of a three-dimensional space assumed for each of the drawings.

An Overall Structure of the Image Forming Apparatus

An image forming apparatus 1 forms images formed of developer onto recording sheets of paper 9. Each of the recording sheets 9 serves as an example of a recording medium. The image forming apparatus 1 is, for example, configured as a printer that forms images in accordance with image information received from an external device such as information terminal device.

The image forming apparatus 1 includes a housing 10 having a generally box-shaped appearance. As illustrated in FIG. 1, an image forming section 2, a fixing device 5, and the like are disposed in an inner space of the housing 10.

The image forming section 2 forms toner images (unfixed images) made of toners as the developers and transfers the toner images onto the recording sheets 9. The fixing device 5 fixes the transferred toner images onto the recording sheets 9. The image forming section 2 according to the first exemplary embodiment includes image forming units 20 (20Y, 20M, 20C, and 20K), an intermediate transfer device 30, and a sheet feed device 40. The image forming units 20 form the toner images. The intermediate transfer device 30 transports the toner images formed by the image forming units 20 such that the toner images are relayed so as to be transferred onto the recording sheets 9 through second transfer. The sheet feed device 40 contains and feeds the recording sheets 9 to be supplied to the second transfer portion of the intermediate transfer device 30. An output container 12 is formed in an upper surface portion of the housing 10. The output container 12 contains the recording sheets 9 output to the outside of the housing 10 after images have been formed on the recording sheets 9. A dotted chain line of FIG. 1 represents a typical overall transport path of each of the recording sheets 9 in the housing 10.

The image forming units 20 include four image forming units 20Y, 20M, 20C, and 20K which respectively form developer (toner) images of four colors, that is, yellow (Y), magenta (M), cyan (C), and black (K).

Each of four image forming units 20 (20Y, 20M, 20C, and 20K) includes, for example, the following components: a photosensitive drum 21 that is a drum-shaped photosensitive member rotated in an arrow A direction; a charger 22 that has, for example, a roller shape and charges an outer circumferential surface of the photosensitive drum 21, the outer circumferential surface serving as an image forming region, to a required voltage; a light exposure device 23 that radiates light of a corresponding one of color components separated in accordance with required image information to the charged outer circumferential surface of the photosensitive drum 21 so as to form an electrostatic latent image of the color component; a developing device 24 (Y, M, C, or K) that develops the electrostatic latent image with a toner of the corresponding color component so that the latent image is made visible as a toner image of the corresponding color (Y, M, C, or K); and a drum cleaner 26 that cleans the outer circumferential surface of the photosensitive drum 21 by removing unwanted substances such as the toner remaining on the outer circumferential surface of the photosensitive drum 21 after the toner image on the photosensitive drum 21 has been transferred onto (an intermediate transfer belt 31 of) the intermediate transfer device 30 through first transfer.

The intermediate transfer device 30 is positioned above four image forming units 20 (20Y, 20M, 20C, and 20K) in the gravity direction.

The intermediate transfer device 30 includes, for example, the following components: the endless intermediate transfer belt 31 capable of holding the toner images having been formed on the photosensitive drums 21 of the image forming units 20 (20Y, 20M, 20C, and 20K) and transferred thereonto by electrostatic action; plural support rollers 32*a* to 32*e* that support the intermediate transfer belt 31 such that the intermediate transfer belt 31 is rotated so as to sequentially pass through first transfer positions of the image forming units 20 (20Y, 20M, 20C, and 20K); first transfer devices 34 that have, for example, a roller shape, are disposed on the inner circumferential side of the intermediate transfer belt 31, and transfer through the first transfer the toner images formed on the photosensitive drums 21 of the image forming units 20 (20Y, 20M, 20C, and 20K) onto the outer circumferential surface of the intermediate transfer belt 31; a second transfer device 35 that has, for example, a roller shape and transfers through the second transfer the toner images having been transferred through the first transfer onto the intermediate transfer belt 31 onto the recording sheet 9; and a belt cleaner 36 that cleans the outer circumferential surface of the intermediate transfer belt 31 by removing unwanted substances such as the toners remaining on the outer circumferential surface of the intermediate transfer belt 31 after the second transfer.

More specifically, the support roller 32*a* serves as a drive roller and also serves as a second transfer backup roller, the support roller 32*b* serves as a cleaning backup roller for the belt cleaner 36, the support roller 32*c* serves as a tension applying roller that applies a required tension to the intermediate transfer belt 31, and the support rollers 32*d* and 32*e* serve as surface forming rollers used to form a first transfer surface of the intermediate transfer belt 31. Furthermore, in the intermediate transfer device 30, the second transfer portion is a portion formed by the second transfer device 35 and part of the intermediate transfer belt 31 where the intermediate transfer belt 31 is supported by the support roller 32*a*.

The sheet feed device 40 is positioned below four image forming units 20 (20Y, 20M, 20C, and 20K) in the gravity direction.

The sheet feed device 40 is attached to the housing 10 such that the sheet feed device 40 is able to be drawn from the housing 10. The sheet feed device 40 includes a sheet container 41 and a feed device 43. The sheet container 41 contains the recording sheets 9 stacked on a loading plate 42. The recording sheets 9 are of a size, type, and the like that a user wishes. The feed device 43 feeds the recording sheets 9 one sheet after another from the sheet container 41. The housing 10 has a sheet feed path provided between the feed device 43 of the sheet feed device 40 and the second transfer portion of the intermediate transfer device 30. The sheet feed path is formed by plural transport roller pairs, a transport guide member, and the like. One of the plural transport roller pairs is a registration roller pair 44 disposed at a position in the sheet feed path upstream of the second transfer portion. The registration roller pair 44 is provided so as to, for example, adjust timing at which each of the recording sheet 9 is transported and correct skewing of the recording sheet 9.

The fixing device 5 is positioned above the second transfer portion of the intermediate transfer device 30 in the gravity direction.

The fixing device 5 includes, for example, the following components disposed in a housing 50 thereof: a heating roller 51 that serves as an example of a heating rotary member, is rotated in a required direction, and is heated by a heater 52 so that the surface temperature thereof is maintained at a required temperature; a pressure roller 53 that serves as an example of a pressure rotary member and is in pressure contact with the heating roller 51 at a required pressure substantially in a rotational axis direction of the heating roller 51 so as to be rotated and form a pressure contact portion (fixing process portion) FN which allows the recording sheet 9 onto which the toner images has been transferred to be introduced thereinto and pass therethrough; and an introduction guide member 54 that guides a leading end portion 9*a* of the recording sheet 9 toward part of an outer circumferential surface of the heating roller 51 approaching the pressure contact portion FN.

The housing 50 has an entrance (opening) 50*a* through which the recording sheet 9 to be subjected to fixing is introduced and an exit (opening) 50*b* through which the recording sheet 9 having undergone the fixing is output. Furthermore, a post-transfer guide member 45 is disposed between the entrance 50*a* side of the housing 50 of the fixing device 5 and the second transfer portion of the intermediate transfer device 30. The post-transfer guide member 45 forms a post-transfer transport path through which the recording sheet 9 having undergone the second transfer is guided toward the entrance 50*a* of the fixing device 5.

The details of the fixing device 5 will be described later.

Image formation is performed by this image forming apparatus 1 as follows. Here, a basic image forming operation that forms an image on a single side of the recording sheet 9 is described as a representative example of the image formation.

Upon reception of a start instruction for an image forming operation, the image forming apparatus 1 performs the following operations in the image forming units 20 (20Y, 20M, 20C, and 20K). That is, the chargers 22 charge to a specified polarity and voltage the outer circumferential surfaces of the photosensitive drums 21 which is started to rotate, and then, the light exposure devices 23 radiate the light corresponding to image signals of the color components to the charged outer circumferential surfaces of the photosensitive drums 21 so as to form electrostatic latent images. Next, the developing devices 24 (Y, M, C, and K) develop the electrostatic latent images of the color components formed on the outer circumferential surfaces of the photosensitive drums 21 by supplying the toners of four colors (Y, M, C, and K) corresponding to the color components. Thus, the toner images of four colors are formed on the photosensitive drums 21 of the respective image forming units 20 (20Y, 20M, 20C, and 20K).

Next, in the intermediate transfer device 30, the toner images of the colors having been formed on the photosensitive drums 21 of the respective image forming units 20 (20Y, 20M, 20C, and 20K) are sequentially transferred through the first transfer performed by the first transfer devices 34 onto the outer circumferential surface of the intermediate transfer belt 31 being rotated in a direction indicated by an arrow. After the first transfer has been performed, the outer circumferential surfaces of the photosensitive drums 21 are cleaned by the drum cleaners 26. The sheet feed device 40 feeds the required recording sheets 9 one sheet after another from the sheet container 41 toward the sheet feed path by using the feed device 43. Next, in the intermediate transfer device 30, the toner images having been transferred through the first transfer onto the intermediate transfer belt 31 are transported to the second transfer portion and collectively transferred through the second transfer performed by the second transfer device 35 onto the recording sheet 9 having been transported from the sheet feed device 40 to the second transfer portion through the sheet feed path. After the second transfer has been performed, the outer circumferential surface of the intermediate transfer belt 31 is cleaned by the belt cleaner 36.

Next, in the intermediate transfer device 30, the recording sheet 9 onto which the toner images have been transferred through the second transfer is removed from the intermediate transfer belt 31, and then, fed to the fixing device 5. The recording sheet 9 after the second transfer is guided to the entrance 50*a* of the housing 50 of the fixing device 5 through, for example, guidance performed by the post-transfer guide member 45, and then, guided by the introduction guide member 54 so as to be introduced into the pressure contact portion FN. Next, in the fixing device 5, the recording sheet 9 onto which the toner images have been transferred through the second transfer is heated and pressed while passing through the pressure contact portion FN formed between the heating roller 51 and the pressure roller 53 which are being rotated. Thus, the toner images are fused and fixed onto the recording sheet 9. The fixing device 5 outputs the recording sheet 9 having undergone this fixing through the exit 50*b* of the housing 50.

At last, the recording sheet 9 having been output from the fixing device 5 is output to the outside of the housing 10 by an output roller pair 49 disposed at an end portion (sheet output opening) of the overall transport path indicated by the dotted chain line and finally received by the output container 12.

Thus, a color image of the toners of four colors (Y, M, C, and K) is formed on one side of a single recording sheet 9, and the basic image forming operation performed by the image forming apparatus 1 is completed. When an instruction for performing the image forming operation on plural sheets is issued, the above-described series of operations are similarly repeatedly performed as many times as the instructed number of sheets.

In the image forming apparatus 1, by selecting and operating all or some (plural) of the image forming units 20 (20Y, 20M, 20C, and 20K), a color image of all or some (at least plural) of the toners of four colors (Y, M, C, and K) combined with one another may be formed. Furthermore, by operating one of the image forming units 20 (20Y, 20M, 20C, and 20K), a monochrome image of one of the toners of the colors, for example, a black may be formed.

Furthermore, for the image forming apparatus 1, a so-called center registration method is adopted as a transport regulating method. The center registration method regulates transport of the recording sheet 9 as follows; that is, the recording sheet 9 is transported so that a portion of the recording sheet 9 matching to the center in a feed width of the recording sheet 9 passes through a position of the transport path matching to the center of a feed width of a recording sheet transport path (transport space) in a range from the sheet feed device 40 to an output portion of the fixing device 5 through the second transfer portion.

A Detailed Structure of the Fixing Device

Next, the fixing device 5 is further described.

Figure 3:
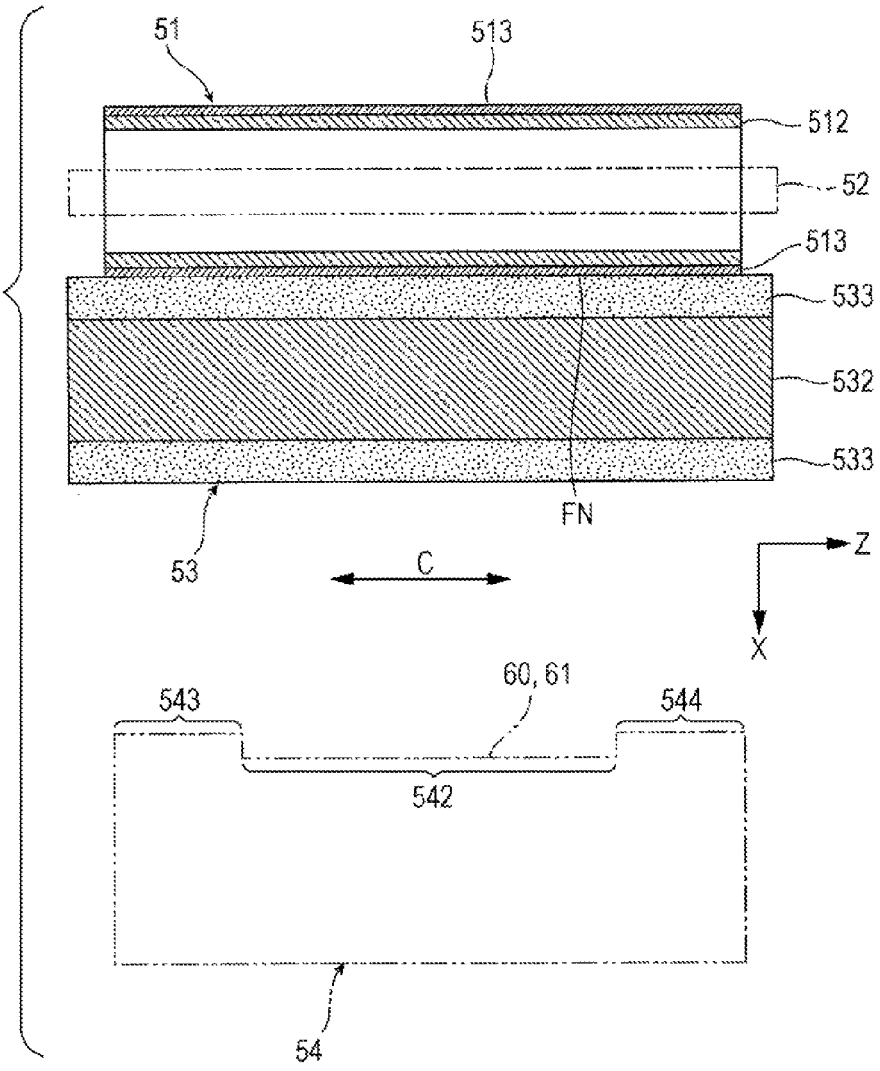
FIG. 3 is a partially sectional view illustrating the relationship between a schematically illustrated section of an introduction guide member and the fixing device of FIG. 2 taken along line III-III.

As illustrated in, for example, FIGS. 2 and 3, the heating roller 51 of the fixing device 5 includes a cylindrical roller base member 512 formed of a material such as a metal material and a surface layer 513 provided on an outer circumferential surface of the roller base member 512. The surface layer 513 has a required thickness and is formed of a material such as silicone. The heating roller 51 may further include another layer such as a mold release layer on the surface layer 513 according to need.

Furthermore, the heating roller 51 is heated by the heater 52 such as a halogen heater provided in an inner space of the roller base member 512 so that the temperature of the outer circumferential surface of the heating roller 51 becomes a required temperature when, for example, forming an image. Furthermore, the temperature of the outer circumferential surface of the heating roller 51 is maintained at the required temperature by controlling operation of the heater 52 while detecting the temperature of the outer circumferential surface of the heating roller 51 by using a temperature sensor (not illustrated). Furthermore, the heating roller 51 is rotatably attached in part of the housing 50 and rotated in a direction indicated by an arrow by a rotating drive transmitted thereto from a rotation drive device (not illustrated).

As illustrated in, for example, FIGS. 2 and 3, the pressure roller 53 of the fixing device 5 includes a cylindrical roller base member 532 formed of a material such as a metal material. An elastic layer 533 formed of a material such as urethane and a mold release layer (not illustrated) formed of a material such as polyimide are provided on an outer circumferential surface of the roller base member 532 in this order. The material of the elastic layer 533 according to the first exemplary embodiment is an elastic material that is elastically deformed so as to follow the shape of the outer circumferential surface of the heating roller 51 when the elastic layer 533 is in pressure contact with the heating roller 51.

Furthermore, the pressure roller 53 is rotatably attached in part of the housing 50 and in pressure contact with the heating roller 51 by receiving a pressure generated by a pressure device (not illustrated).

As illustrated in, for example, FIGS. 2 to 4B, the introduction guide member 54 of the fixing device 5 is structured as a continuous member that has a guide portion 541, which guides the leading end portion 9*a* of the recording sheet 9, such that the guide portion 541 gradually approaches the pressure contact portion FN. Furthermore, the introduction guide member 54 is disposed such that a guide ending portion 541*b* where the guide portion 541 ends the guidance exists on the heating roller 51 side of a tangent FL on an entrance side of the pressure contact portion FN. Furthermore, the introduction guide member 54 is secured such that a guide starting portion 541*a* located on a side where the guide portion 541 starts the guidance exists at an edge of the opening of the entrance 50*a* of the housing 50. The introduction guide member 54 according to the first exemplary embodiment includes a flat plate-shaped member that includes the guide portion 541 having a flat surface.

Figure 4A:
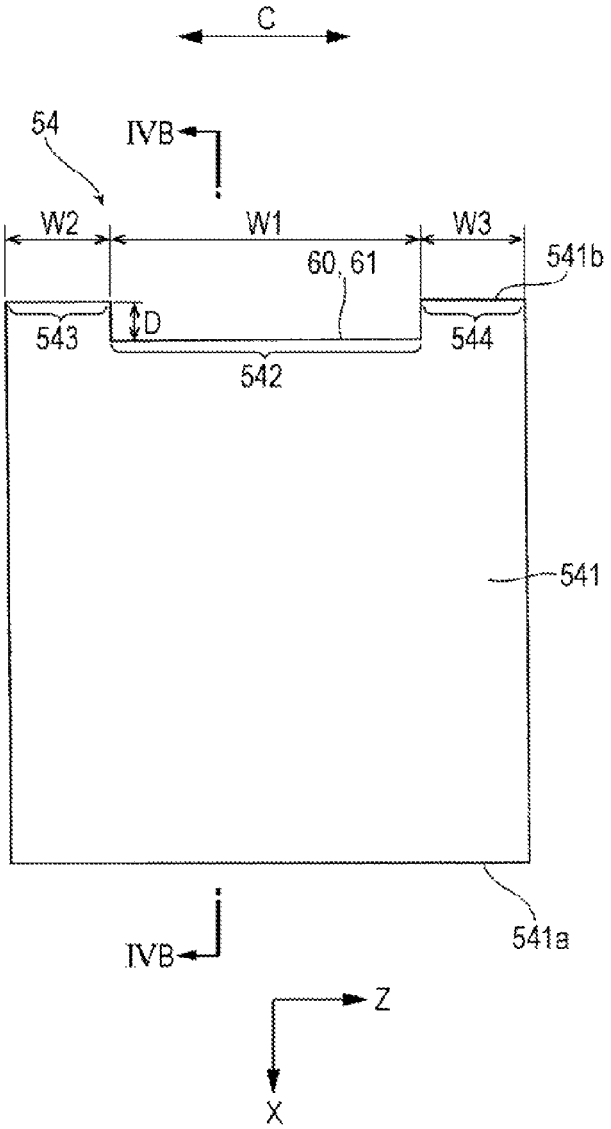
FIGS. 4A and 4B illustrate the structure of the introduction guide member of the fixing device of FIG. 3, and out of FIGS. 4A and 4B.
Figure 4B:
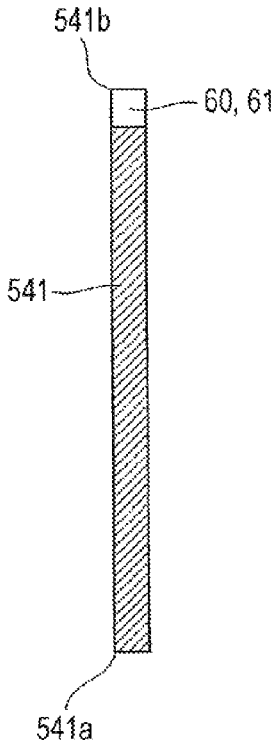

Furthermore, as illustrated in, for example, FIGS. 4A and 4B, in a direction parallel to a rotational axis direction C (direction along the coordinate axis Z) of the heating roller 51, a central portion 542 out of the guide ending portion 541*b* of the guide portion 541 has a recessed shape 60 recessed relative to end portions 543 and 544 in the introduction guide member 54. The end portions 543 and 544 are both end portions of the guide ending portion 541*b* other than the central portion 542 and guide left and right end portions of the recording sheet 9 being transported. The recessed shape 60 of the introduction guide member 54 according to the first exemplary embodiment has the shape of an elongated box-shaped cut (cut shape) 61, which is a cut in the central portion 542 of the guide ending portion 541*b* from the guide ending portion 541*b* toward the upstream side in the transport direction of the recording sheet 9 by dimension (depth of the cut) D.

The central portion 542 of the guide ending portion 541*b* of the guide portion 541 allows a central portion (toner image transfer side 91) (FIG. 6B) of the feed width (dimension in the rotational axis direction C) of the recording sheet 9 used for the image formation to be deformed so as to be bent toward the opposite side to the guide portion 541 in the thickness direction of the introduction guide member 54 relative to both end portions of the feed width. A width (cut width) W1 of the central portion 542 in the rotational axis direction C is set to be a dimension smaller than a feed width of one of the types of the recording sheets 9 having a smallest feed width out of types of the recording sheets 9 used for the image formation, or set to be a dimension applicable to at least a type of the recording sheet 9 with which smudging easily occurs. The smudging will be described later.

Meanwhile, the left and right end portions 543 and 544 of the guide ending portion 541*b* of the guide portion 541 support and guide both the end portions of the feed width of the recording sheet 9 used for the image formation. The dimensions of widths W2 and W3 of the left and right end portions 543 and 544 in the rotational axis direction C is obtained by dividing a dimension obtained by subtracting the cut width W1 of the central portion 542 from the width of the guide ending portion 541*b* of the guide portion 541. Although the dimensions of the widths W2 and W3 are set to be the same, the dimensions of widths W2 and W3 may be different from each other.

Furthermore, it is sufficient that the cut depth D of the cut shape 61 is a dimension that allows, after the leading end portion 9*a* of the recording sheet 9 has been introduced into the pressure contact portion FN, the central portion of the feed width (toner image transfer side 91) in part of the recording sheet 9 on the trailing end side not having reached the pressure contact portion FN to be deformed so as to be bent toward the opposite side to the guide portion 541 in the thickness direction of the introduction guide member 54 relative to both the end portions of the feed width. The cut depth D is set to be, for example, at least 1 mm or larger, and preferably, set to be 5 mm or larger. In contrast, an upper limit value of the cut depth D is set, for example, while considering the following conditions: reduction of the likelihood of causing damage to the leading end portion 9*a* when the leading end portion 9*a* of the recording sheet 9 is in contact with the cut shape 61; reduction of the likelihood of paper jam arising from contact of the recording sheet 9 with the cut shape 61; reduction of the likelihood of unevenness in fixing occurring due to the effect on the position of the recording sheet 9 in the pressure contact portion FN, and the like.

An output guide member 55 of the fixing device 5 guides the recording sheet 9 having passed through the pressure contact portion FN so as to separate the recording sheet 9 from the heating roller 51 and direct the recording sheet 9 toward the exit 50*b* of the housing 50. The output guide member 55 is disposed such that a guide starting portion 551*a* of a guide portion 551 that guides the recording sheet 9 is disposed close to part of the outer circumferential surface of the heating roller 51 past the pressure contact portion FN and a guide ending portion 551*b* of the guide portion 551 exists at an edge portion of the exit 50*b* of the housing 50.

Furthermore, in the fixing device 5 according to the first exemplary embodiment, the rotational speed of the heating roller 51 is set to be slightly lower (by, for example, 0.1 to 2%) than the rotational speed of the support roller 32*a*, which also serves as the drive roller, of the second transfer portion of the intermediate transfer device 30. Thus, the transport speed of the recording sheet 9 is lower when the recording sheet 9 is nipped in the pressure contact portion FN of the fixing device 5 than when the recording sheet 9 is nipped in a pressure contact portion (transfer portion) TN by a speed substantially corresponding to the speed by which the rotational speed of the heating roller 51 is reduced. The intermediate transfer belt 31 and the second transfer device 35 are in pressure contact with each other in the pressure contact portion TN of the second transfer portion.

Furthermore, the post-transfer guide member 45 has a guide portion 451 between the second transfer portion of the intermediate transfer device 30 and the introduction guide member 54 of the fixing device 5. The guide portion 451 guides the leading end portion 9*a* of the recording sheet 9 so as to cause the leading end portion 9*a* to be brought into contact with at least the guide portion 541 of the introduction guide member 54. The post-transfer guide member 45 is disposed such that a guide starting portion 451*a* serving as a starting side end portion of the guide portion 451 is disposed close to part of the outer circumferential surface of the second transfer device (second transfer roller) 35 past the pressure contact portion TN and a guide ending portion 451*b* on a side where the guide portion 451 ends the guidance is disposed close to the guide starting portion 541*a* of the guide portion 541 of the introduction guide member 54.

Fixing Operation Performed by the Fixing Device

Fixing operation performed by the fixing device 5 is described below.

Initially, when the fixing device 5 is operated for, for example, the image formation, the heating roller 51 is rotated in the direction indicated by the arrow and maintained in a state in which the heating roller 51 is heated to the required temperature by the heater 52. The pressure roller 53 is rotated by following the rotating heating roller 51. Here, in the fixing device 5, as illustrated in FIG. 3, the shape of the pressure contact portion FN in the rotational axis direction C is substantially straight because the heating roller 51 has a shape in which the outer diameter of the heating roller 51 is uniform entirely in the rotational axis direction C.

When the image forming operation is started, as exemplified by a two-dot chain arrow of FIG. 2, the recording sheet 9 onto which the toner images have been transferred through the second transfer by the second transfer portion of the intermediate transfer device 30 of the image forming section 2 is fed from the pressure contact portion TN of the second transfer portion, and then, transported to the entrance 50*a* of the housing 50 of the fixing device 5 through, for example, guidance performed by the post-transfer guide member 45.

Figure 5A:
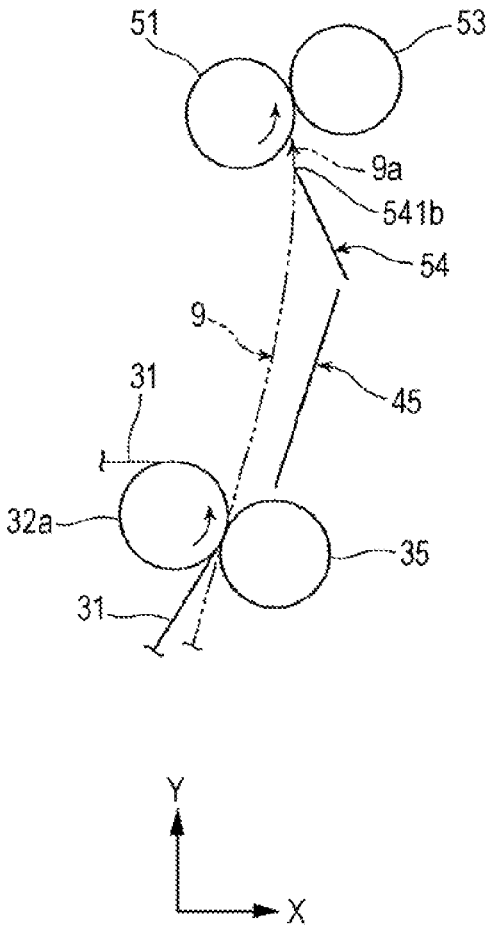
FIGS. 5A and 5B illustrate part of an operation performed by the fixing device of FIG. 2, and out of FIGS. 5A and 5B.
Figure 5B:
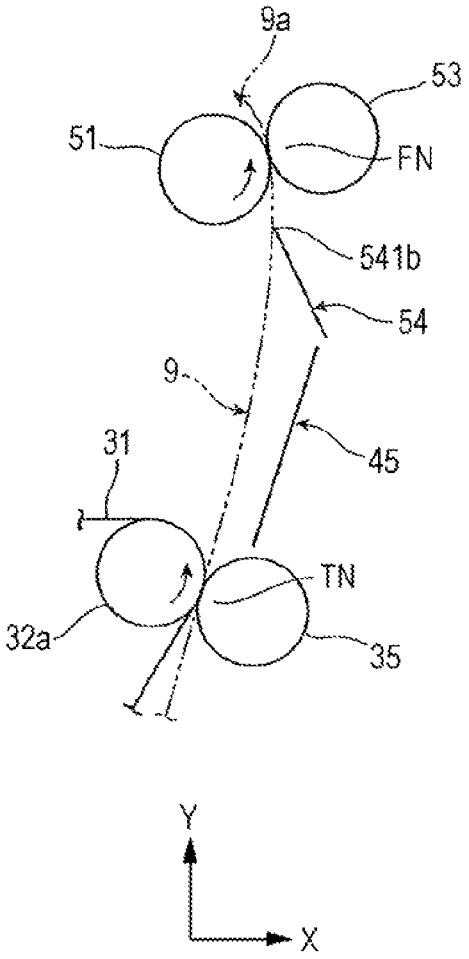

Referring next to FIGS. 5A and 5B, the leading end portion 9*a* of the recording sheet 9 on the downstream side in the transport direction of the recording sheet 9 having been transported to the entrance 50*a* of the fixing device 5 is brought into contact with the guide portion 541 of the introduction guide member 54 of the fixing device 5 so as to be guided to part of the outer circumferential surface of the heating roller 51 approaching the pressure contact portion FN (FIG. 5A). After that, the leading end portion 9*a* of the recording sheet 9 is introduced into and passes through the pressure contact portion FN formed between the heating roller 51 and the pressure roller 53 which are being rotated (FIG. 5B) in the fixing device 5.

In so doing, the recording sheet 9 is heated and pressed in the pressure contact portion FN as described above, thereby the toner images are fixed.

Furthermore, at the start of the introduction of the leading end portion 9*a* of the recording sheet 9 into the pressure contact portion FN of the fixing device 5, part of the recording sheet 9 on the trailing end side not having reached the pressure contact portion FN is nipped in the pressure contact portion TN of the second transfer portion (FIG. 5B).

Furthermore, while the recording sheet 9 is being nipped in both the pressure contact portion FN of the fixing device 5 and the pressure contact portion TN of the second transfer portion, the part of the recording sheet 9 on the trailing end side not having reached the pressure contact portion FN of the fixing device 5 is affected by the transport speed in the pressure contact portion TN of the second transfer portion due to the above-described difference in rotational speed between the heating roller 51 and the support roller 32*a*, so that the part of the recording sheet 9 on the trailing end side not having reached the pressure contact portion FN of the fixing device 5 is transported (fed from the pressure contact portion TN) at a speed relatively higher than the speed at which the part of the recording sheet 9 on the leading end portion 9*a* side nipped in the pressure contact portion FN of the fixing device 5 is transported. Thus, part of the recording sheet 9 nipped in both the pressure contact portion FN of the fixing device 5 and the pressure contact portion TN of the second transfer portion is in an unstable state in which this part of the recording sheet 9 tends to be slightly deformed.

Figure 6A:
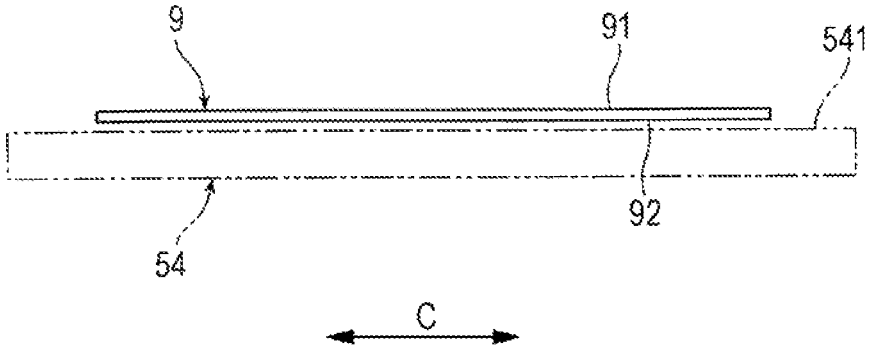
FIG. 6A illustrates a state in which the recording sheet is introduced into and passes through the introduction guide member.
Figure 6B:
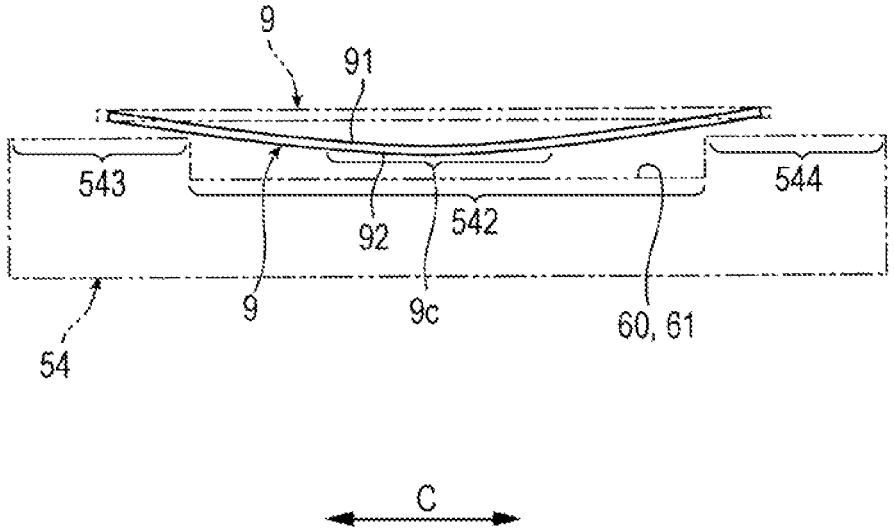
FIG. 6B illustrates a state in which the recording sheet approaches or is brought into contact with and passes through a guide ending portion of a guide portion of the introduction guide member of the fixing device.

When the recording sheet 9 is transported while being in contact with the guide portion 541 of the introduction guide member 54 of the fixing device 5 (FIG. 5A), part of the recording sheet 9 in contact with the guide portion 541, the part of the recording sheet 9 extending in the rotational axis direction C of the heating roller 51, is maintained in a state in which this part of the recording sheet 9 substantially straightly extends so as to follow the flat shape of the guide portion 541 as exemplified in FIG. 6A. Reference numeral 91 of, for example, FIGS. 6A and 6B, denotes the transfer (printing) surface (transfer side) of the recording sheet 9 onto which the toner images to be fixed have been transferred, and reference numeral 92 denotes a non-transfer side of the recording sheet 9.

Furthermore, when the recording sheet 9 is introduced into and passes through the pressure contact portion FN of the fixing device 5 (FIG. 5B), the shape of which in the rotational axis direction C is substantially straight (FIG. 3) as described above, part of the recording sheet 9 along the pressure contact portion FN, the part of the recording sheet 9 extending in the rotational axis direction C, is maintained in a state in which this part of the recording sheet 9 substantially straightly extends so as to follow the shape of the pressure contact portion FN in the rotational axis direction C.

Furthermore, when the leading end portion 9*a* of the recording sheet 9 is introduced into the pressure contact portion FN, part of the recording sheet 9 on the trailing end side not having reached the pressure contact portion FN approaches or is brought into contact with and passes through the guide ending portion 541*b* of the guide portion 541 of the introduction guide member 54 (FIG. 5B). At this time, since the central portion 542 of the guide ending portion 541*b* of the guide portion 541 of the introduction guide member 54 has the recessed shape 60 (FIGS. 3 to 4B), this part of the recording sheet 9 on the trailing end side is maintained in the following state: that is, at this time, as exemplified in FIG. 6B, the left and right end portions of the transfer side 91 in the rotational axis direction C of this part of the recording sheet 9 extending in the rotational axis direction C are supported by both the end portions 543 and 544 of the guide ending portion 541*b* of the guide portion 541, and, in contrast, a central portion 9*c* of the transfer side 91 in the rotational axis direction C of this part of the recording sheet 9 enters a space of the recessed shape 60 and is deformed so as to be recessed without being supported by the guide ending portion 541*b* of the guide portion 541. In particular with the introduction guide member 54 according to the first exemplary embodiment, since the recessed shape 60 is the cut shape 61, the above-described central portion 9*c* of the recording sheet 9 may reliably enter the space formed by the cut shape 61. Thus, this central portion 9*c* of the recording sheet 9 may be more reliably deformed so as to be recessed.

Figure 7A:
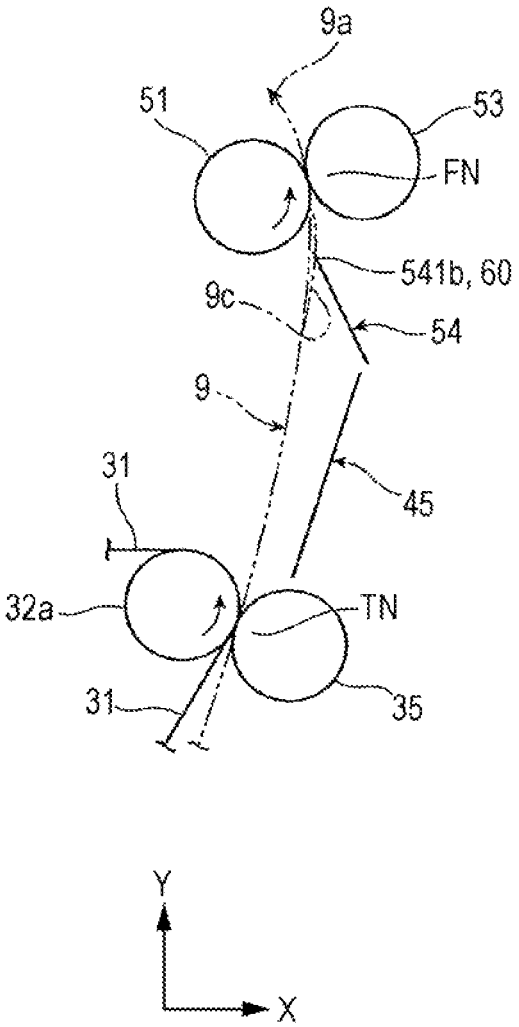
FIGS. 7A and 7B illustrate part of the operation performed by the fixing device of FIG. 2, and out of FIGS. 7A and 7B.
Figure 7B:
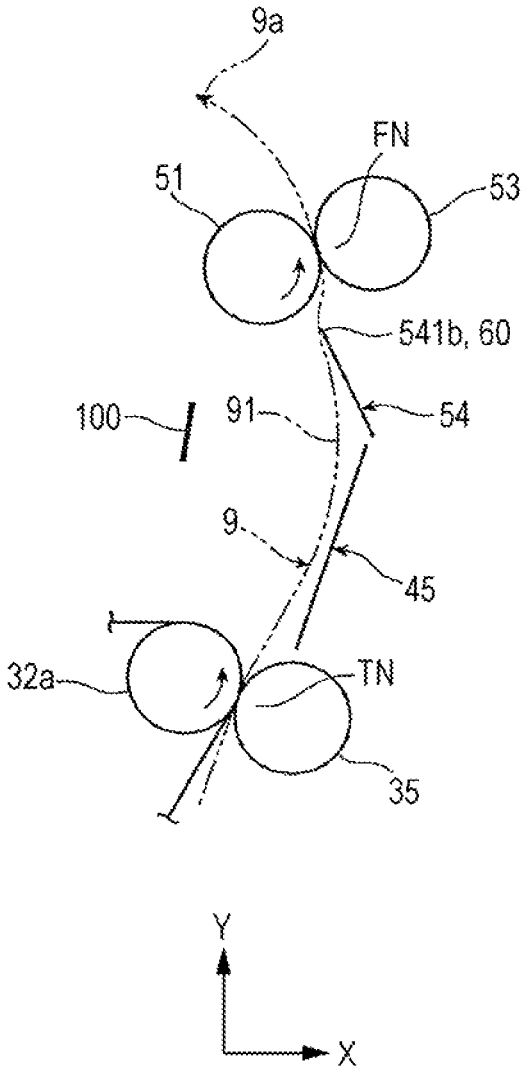

Thus, in this fixing device 5, the part of the recording sheet 9 on the trailing end side not having reached the pressure contact portion FN is, as described above, fed from the pressure contact portion TN of the second transfer portion and transported toward the fixing device 5 at a relatively high speed. However, at this time, as illustrated in FIG. 7A, the central portion 9*c* of this recording sheet 9 passing through the guide ending portion 541*b* of the guide portion 541 of the introduction guide member 54 is maintained in, as described above, the following shape: that is, this central portion 9*c* of the recording sheet 9 is deformed so as to be recessed into the recessed shape 60 of the central portion 542 of the guide ending portion 541*b*. Thus, as illustrated in FIG. 7B, the part of the recording sheet 9 (non-transfer side 92) on the trailing end side not having reached the pressure contact portion FN is transported in a state in which this part of the recording sheet 9 is deformed so as to be curved toward the post-transfer guide member 45 and the introduction guide member 54 in the transport direction.

Figure 16:
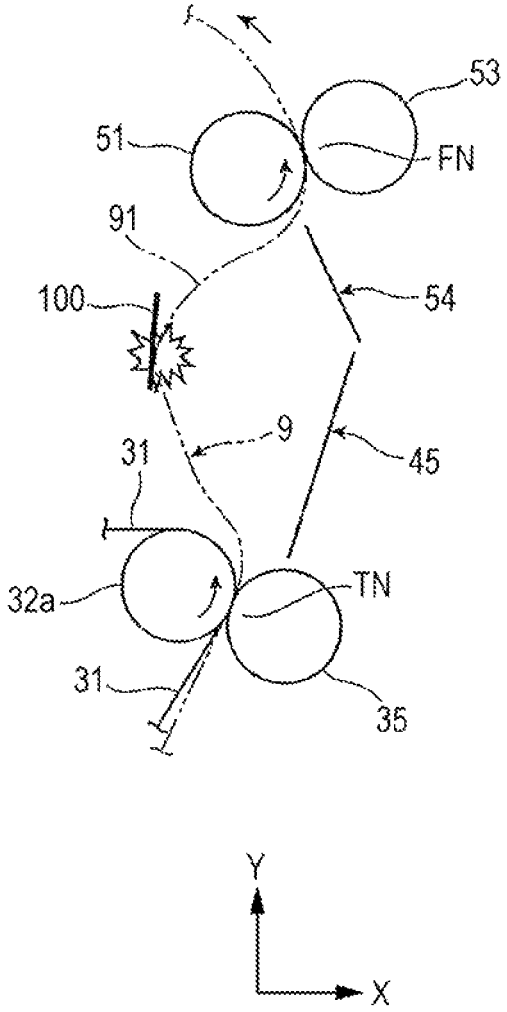
FIG. 16 illustrates a state of the recording sheet when the image disturbances occur in the fixing device of FIGS. 15A and 15B.

As a result, the occurrences of the following situation may be avoided with the fixing device 5: that is, the part of the recording sheet 9 (transfer side 91) on the trailing end side not having reached the pressure contact portion FN is brought into contact with (slides against) the outer circumferential surface of the heating roller 51 or peripheral components 100 (for example, a support member of the image forming apparatus 1 and an edge portion of the entrance 50*a* of the housing 50 of the fixing device 5) disposed upstream of the heating roller 51 in the transport direction of the recording sheet 9 (see FIG. 16).

Accordingly, this fixing device 5 may suppress image disturbances (so-called smudging) caused by the contact of part of the transfer side 91 of the recording sheet 9 with the peripheral components 100 disposed upstream of the heating roller 51 in the transport direction of the recording sheet 9, the outer circumferential surface of the heating roller 51, or the like after part of the recording sheet 9 on the leading end portion 9*a* side of the recording sheet 9 onto which the toner images have been transferred has been introduced into the pressure contact portion FN.

Figure 8:
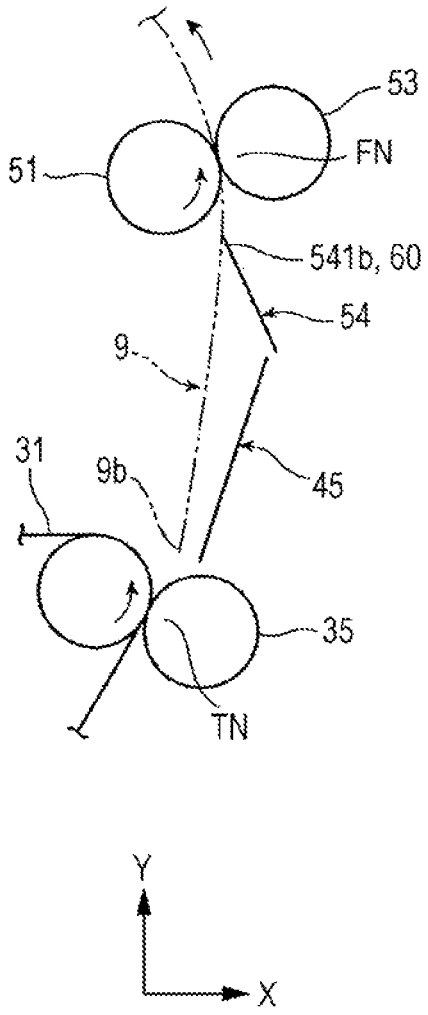
FIG. 8 is a view of part of the operation performed by the fixing device of FIG. 2 illustrating a state of the recording sheet the trailing end of which is fed from the second transfer portion.

In the fixing device 5, when a trailing end 9*b* of the recording sheet 9 is finally fed from the pressure contact portion TN of the second transfer portion, as exemplified in FIG. 8, the state in which the part of the recording sheet 9 on the trailing end side not having reached the pressure contact portion FN is deformed so as to be curved toward the post-transfer guide member 45 and the introduction guide member 54 in the transport direction is released and eliminated. Specifically, even at this time, the part of the recording sheet 9 on the trailing end side not having reached the pressure contact portion FN passes through and is transported while being in contact with or approaching the guide ending portion 541*b* of the guide portion 541 of the introduction guide member 54.

Thus, the fixing device 5 may suppress the occurrences of the smudging, and accordingly, the image forming apparatus 1 using the above-described fixing device 5 may form images in which the image disturbances caused by the smudging in the fixing device 5 are suppressed.

When an introduction guide member 540, in which the guide ending portion 541*b* of the guide portion 541 has a straight shape without the recessed shape 60, is applied to the fixing device 5 instead of the above-described introduction guide member 54, the smudging may occur as described below.

Figure 15A:
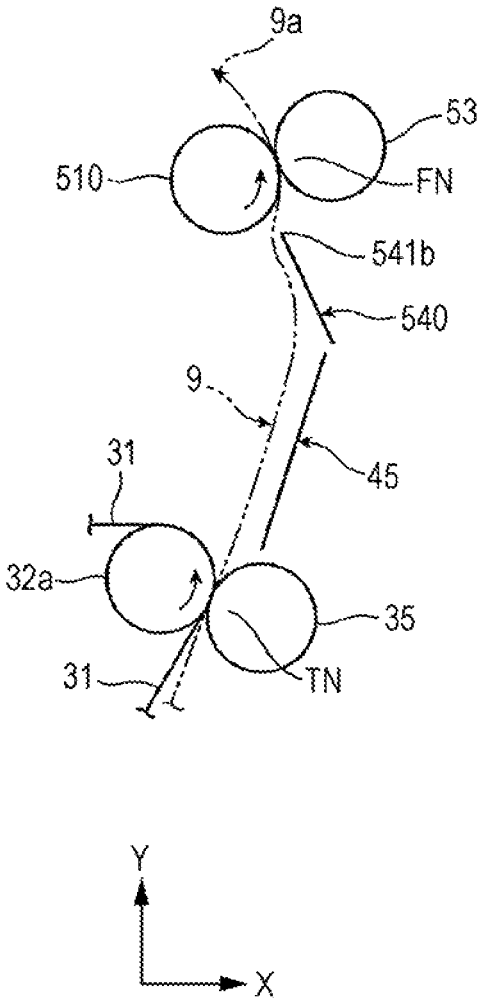
FIGS. 15A and 15B illustrate part of the operation performed by a fixing device to be compared which may cause image disturbances, and out of FIGS. 15A and 15B.

That is, in the fixing device 5 to which the above-described introduction guide member 540 is applied, as exemplified in FIG. 15A, when the recording sheet 9 onto which the toner images have been transferred is started to be introduced into the pressure contact portion FN formed between the heating roller 510 and the pressure roller 53, part of the recording sheet 9 having been introduced into the pressure contact portion FN is maintained in the shape corresponding to the substantially straight shape of the pressure contact portion FN in the rotational axis direction C. At this time, part of the recording sheet 9 approaching or being brought into contact with the straight guide ending portion 541*b* of the guide portion 541 of the introduction guide member 540 is also maintained in the shape substantially corresponding to the shape of this guide ending portion 541*b*. Furthermore, part of the recording sheet 9 on the trailing end side not having reached the pressure contact portion FN is transported at a relatively high speed by the pressure contact portion TN of the second transfer portion. Thus, the part of the recording sheet 9 on the trailing end side not having reached the pressure contact portion FN starts to be curved so as to approach the outer circumferential surface of the heating roller 510 in a region between the pressure contact portion FN and the guide ending portion 541*b* of the guide portion 541 of the introduction guide member 540.

Figure 15B:
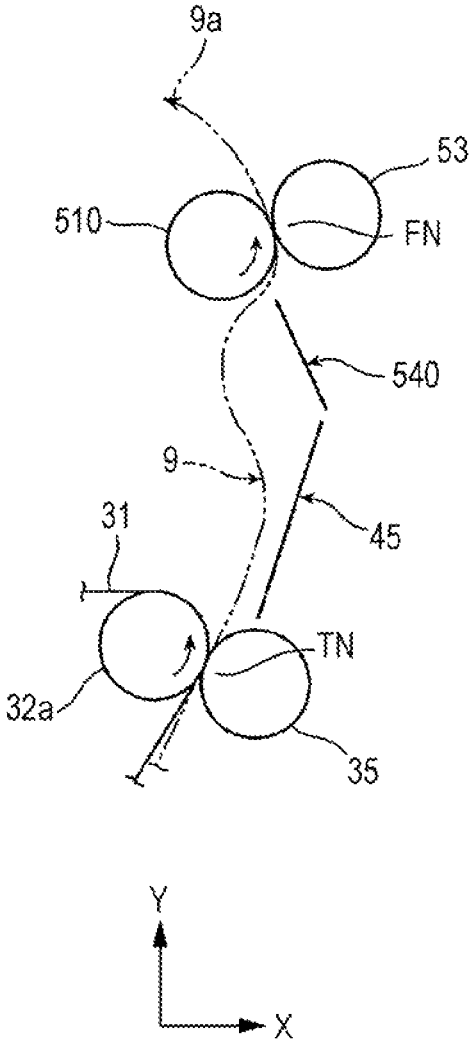

After that, as illustrated in FIG. 15B, the part of the recording sheet 9 on the trailing end side not having reached the pressure contact portion FN is transported in a state in which this part of the recording sheet 9 is, triggered by the start of the change into this curved state, deformed so as to be curved away from the introduction guide member 540 and the post-transfer guide member 45 in the transport direction. As a result, as exemplified in FIG. 16, the part of the recording sheet 9 (transfer side 91) having been deformed so as to be curved is brought into contact with the peripheral components 100 disposed upstream of the heating roller 51 in the transport direction of the recording sheet 9 or the outer circumferential surface of the heating roller 51. This may lead to the occurrences of the smudging.

Such smudging may tend to occur particularly when a sheet of paper having a comparatively low stiffness and a comparatively large length in the transport direction (for example, a thin sheet of paper having a large length during transport) is used as the recording sheet 9. The reason for this is that, with a sheet of paper having a comparatively low stiffness and a comparatively large length, part of the sheet on the trailing end side not having reached the pressure contact portion FN is easily deformed so as to be curved as described above. Furthermore, with such a sheet, the degree of the deformation into a curve tends to increase.

Second Exemplary Embodiment

Figure 9:
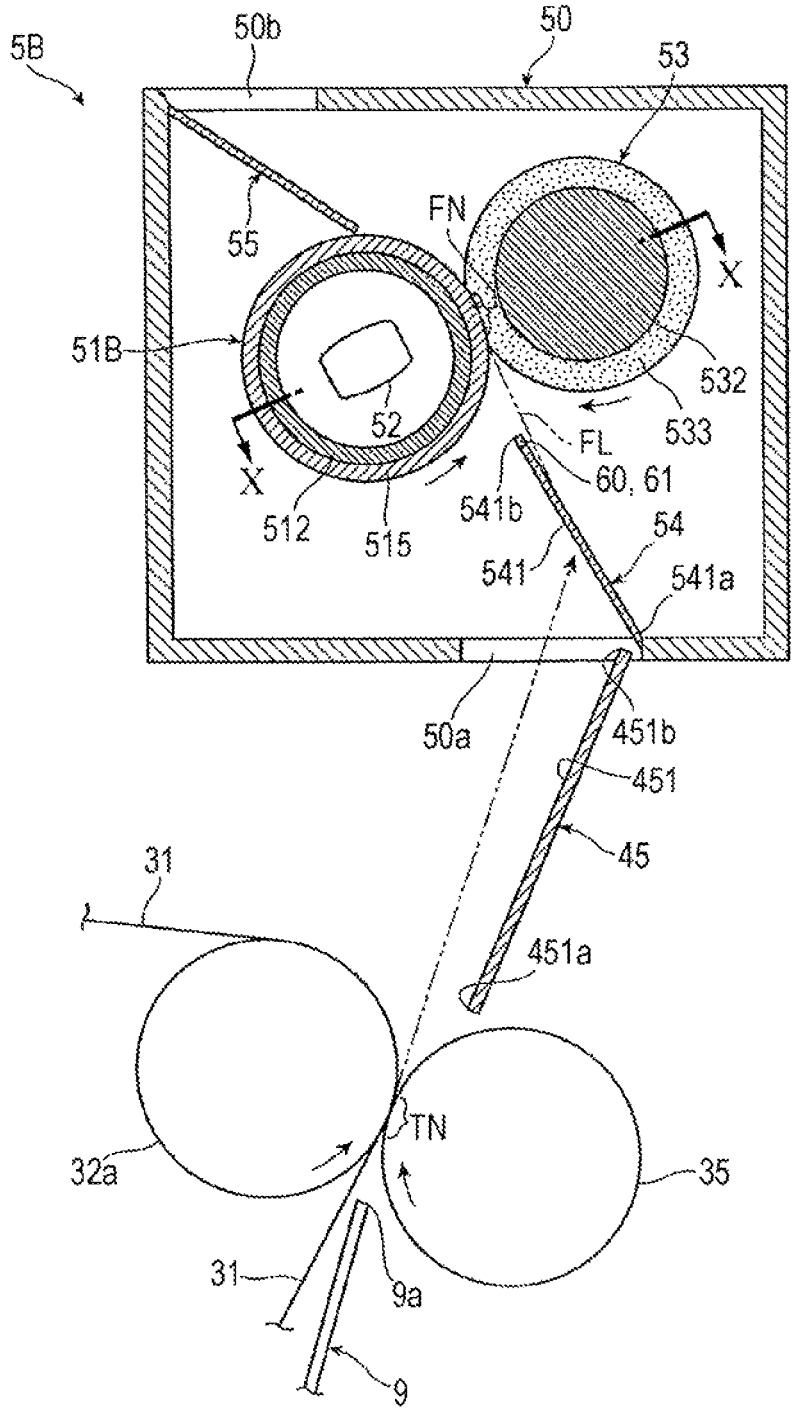
FIG. 9 is a partially sectional view illustrating another structural example of the fixing device.

FIG. 9 illustrates part of the image forming apparatus 1 using a fixing device 5B according to a second exemplary embodiment.

The difference between the fixing device 5 according to the first exemplary embodiment and the fixing device 5B according to the second exemplary embodiment is that a heating roller 51B is applied as the heating roller to the fixing device 5B. The heating roller 51B has, as illustrated in, for example, FIGS. 10 and 11, a shape in which an outer diameter R of the heating roller 51B gradually reduces from a center P1 toward both ends P2 and P3 in the rotational axis direction C (so-called crowned-roller shape or spindle shape). Other than the heating roller 51B, the structures of the fixing device 5 and the fixing device 5B are the same.

The outer diameter R of the heating roller 51B of the fixing device 5B is largest at the center P1 where the outer diameter is R1 and smallest at both the ends P2 and P3 where the outer diameters are R2 and R3. The outer diameters R2 and R3 are the same. Both the ends P2 and P3 of the heating roller 51B are, for example, both ends of a region through which one of types of the recording sheets 9 having a largest width out of types of the recording sheets 9 to be subjected to the fixing passes. This region is in a range of the outer circumferential surface of the heating roller 51B in the rotational axis direction C.

This heating roller 51B having a non-uniform outer diameter R is formed by, for example, processing a surface layer 515 provided on the roller base member 512 having a uniform outer diameter in the rotational axis direction C, so that the heating roller 51B has the above-described outer diameter R. The surface layer 515 subjected to such processing is formed of, for example, a material such as silicone. Furthermore, the difference (in percentage) by which the outer diameter R1 at the center P1 is larger than the outer diameters R2 and R3 at both the ends P2 and P3 in the heating roller 51B is preferably set in a range, for example, from 0.1 to 1.0%. In the case where the difference in the outer diameter is less than the above-described lower limit value, problems including the following problems may arise: that is, the effect of suppressing the occurrences of the image disturbances, which will be described later, is not obtained or unlikely to be obtained; and the position of the recording sheet 9 is unstable while being transported through the pressure contact portion FN. In contrast, in the case where the difference in the outer diameter is more than the above-described upper limit value, problems including the following problem may arise: that is, creasing (paper crease) in the recording sheet 9 occurs when the recording sheet 9 passes through the pressure contact portion FN.

Furthermore, the material of the pressure roller 53 of the fixing device 5B is an elastic material that is elastically deformed so as to follow the shape of the outer circumferential surface of the heating roller 51B when the elastic layer 533 of the pressure roller 53 is in pressure contact with the heating roller 51B.

In this fixing device 5B, the shape of the outer circumferential surface of the heating roller 51B is formed such that the outer diameter R of the heating roller 51B gradually reduces from the center P1 toward both the ends P2 and P3 in the rotational axis direction C, and the elastic layer 533 of the pressure roller 53 is elastically deformed so as to follow the shape of the outer circumferential surface of the heating roller 51B when the elastic layer 533 is in pressure contact with the heating roller 51B. This causes the pressure contact portion FN to have a curved shape in the rotational axis direction C in which a central portion projects toward the pressure roller 53 side as exemplified in FIG. 10 in this fixing device 5B.

Figure 10:
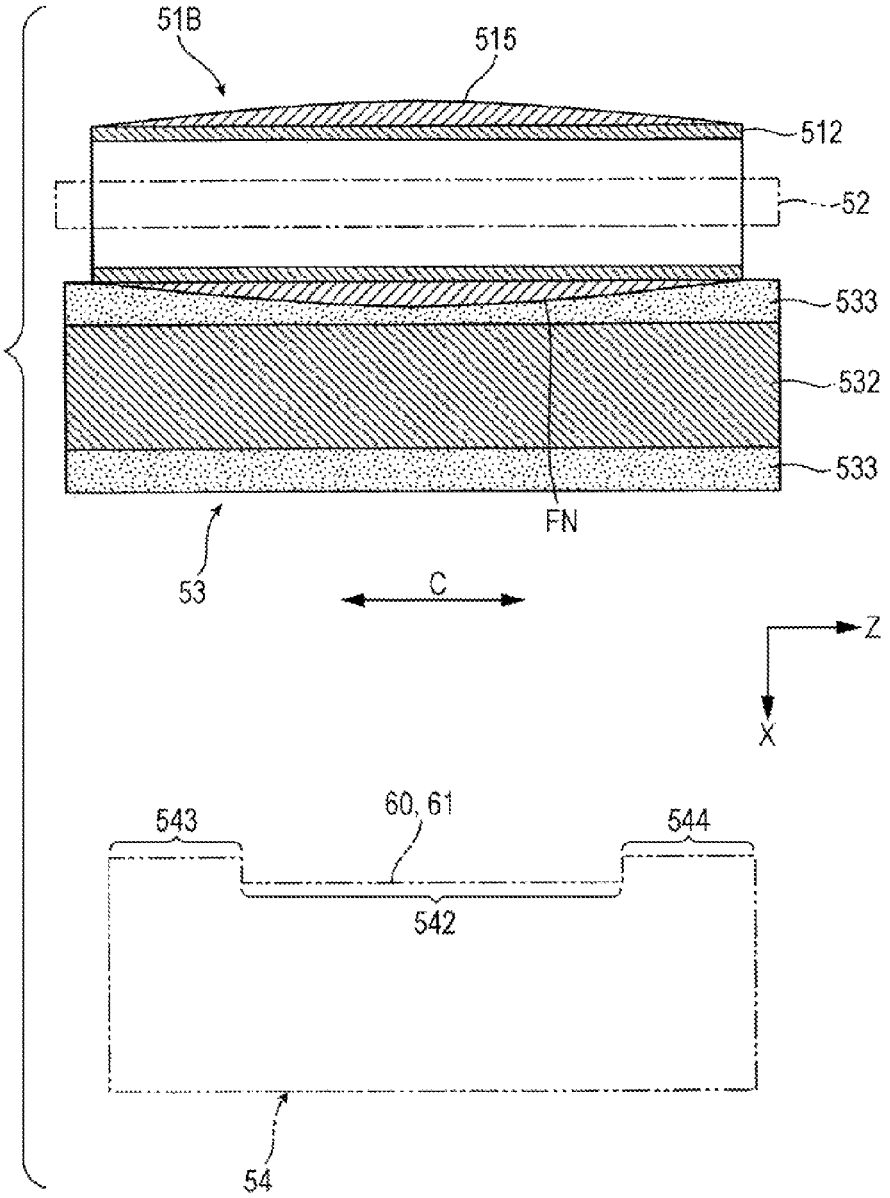
FIG. 10 is a partially sectional view illustrating the relationship between the introduction guide member and a schematically illustrated section of the fixing device of FIG. 9 taken along line X-X.
Figure 11:
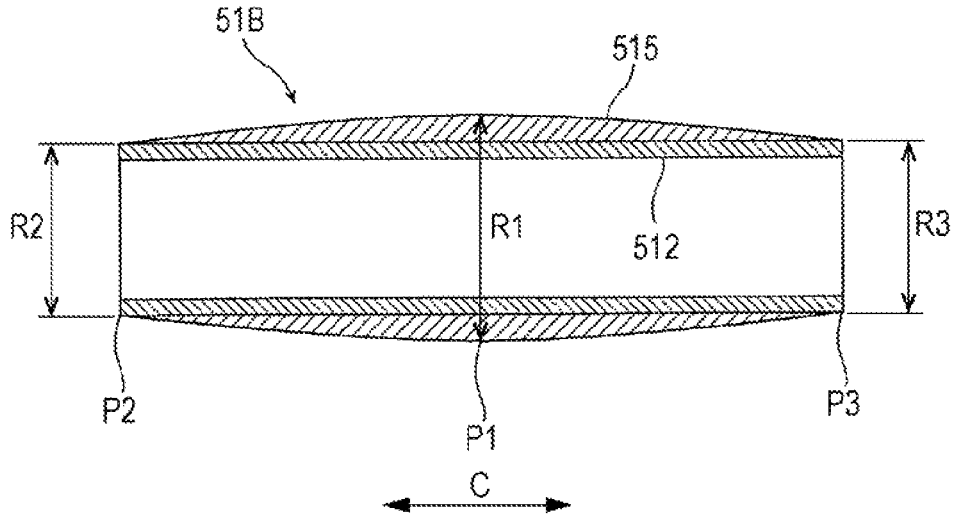
FIG. 11 is a sectional view illustrating the structure of a heating roller of the fixing device of FIG. 9.

Furthermore, during the fixing operation performed by the fixing device 5B, when the recording sheet 9 is introduced into and passes through the pressure contact portion FN of the fixing device 5B (FIG. 12), the shape of the pressure contact portion FN in the rotational axis direction C is a curved shape in which a central portion projects due to the above-described shape of the outer circumferential surface of the heating roller 51B (FIG. 10). Thus, part of the recording sheet 9 extending in the rotational axis direction C having been introduced into the pressure contact portion FN is maintained in a state in which, as exemplified in FIG. 13A, the central portion 9*c* of this part of the transfer side 91 of the recording sheet 9 in the rotational axis direction C is deformed so as to be recessed.

Figure 12:
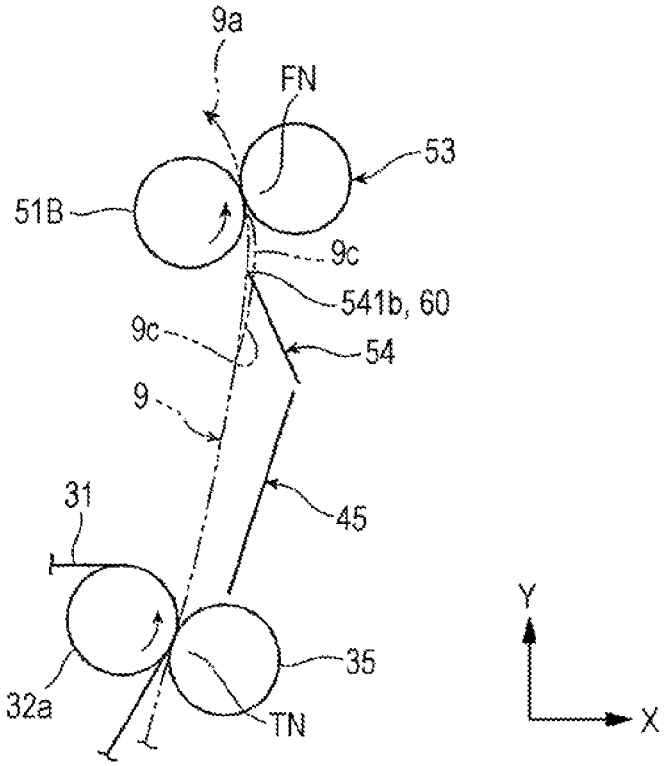
FIG. 12 is a view of part of the operation performed by the fixing device of FIG. 9 illustrating a state in which part of the recording sheet on the leading end side is introduced into and passes through the pressure contact portion of the fixing device and part of the recording sheet on the trailing end side approaches or is brought into contact with and passes through the guide ending portion of the guide portion of the introduction guide member.
Figure 13A:
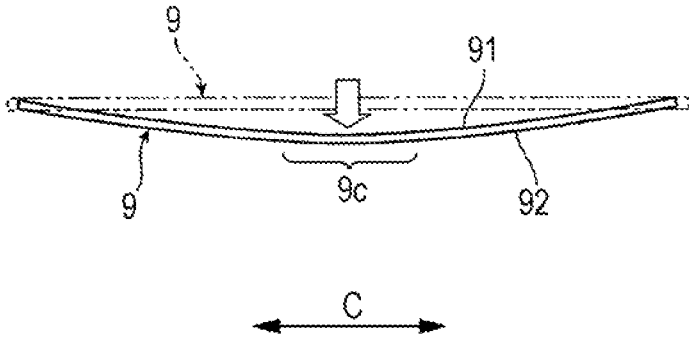
FIG. 13A illustrates a state in which the recording sheet is introduced into and passes through the pressure contact portion of the fixing device of FIG. 9.
Figure 13B:
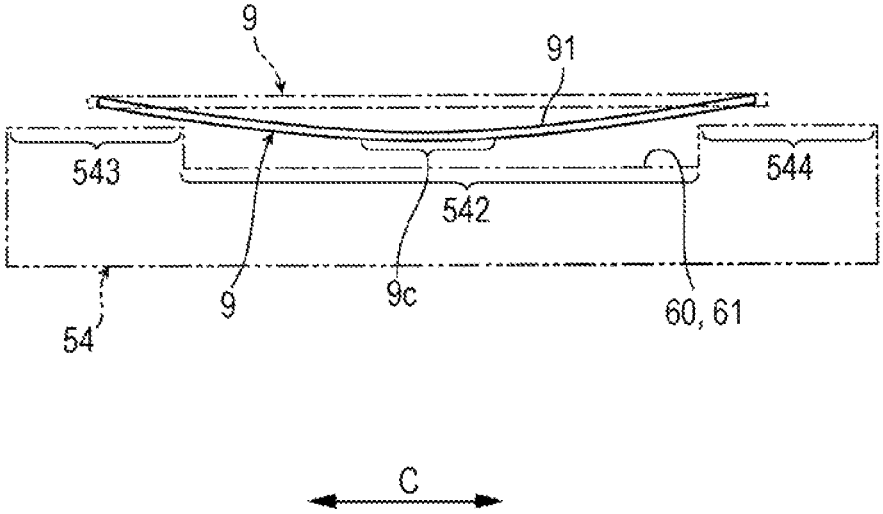
FIG. 13B illustrates a state in which the recording sheet approaches or is brought into contact with and passes through the guide ending portion of the guide portion of the introduction guide member of the fixing device of FIG. 9.

Furthermore, with this fixing device 5B, when the leading end portion 9*a* of the recording sheet 9 is introduced into the pressure contact portion FN, part of this recording sheet 9 on the trailing end side not having reached the pressure contact portion FN approaches or is brought into contact with and passes through the guide ending portion 541*b* of the guide portion 541 of the introduction guide member 54 (FIG. 12). Here, the central portion 542 of the guide ending portion 541*b* of the guide portion 541 of the introduction guide member 54 has the recessed shape 60 (FIGS. 10 and 13B). Thus, as is the case with the first exemplary embodiment, the central portion 9*c* of part of the transfer side 91 of the recording sheet 9 in the rotational axis direction C enters the space of the recessed shape 60 and is maintained in a state in which this central portion 9*c* is deformed so as to be recessed.

In this fixing device 5B, the part of the recording sheet 9 on the trailing end side not having reached the pressure contact portion FN is, as described above, fed from the pressure contact portion TN of the second transfer portion and transported toward the fixing device 5B at a relatively high speed. However, at this time, as illustrated in FIG. 7A, the central portion 9*c* of this recording sheet 9 passing through the guide ending portion 541*b* of the guide portion 541 of the introduction guide member 54 is, as described above, maintained in the following shape: that is, this central portion 9*c* of the recording sheet 9 is deformed so as to be recessed by both the pressure contact portion FN and the recessed shape 60 of the guide ending portion 541*b* of the guide portion 541 of the introduction guide member 54. Thus, the part of the recording sheet 9 (non-transfer side 92) on the trailing end side not having reached the pressure contact portion FN is transported in a state in which this part of the recording sheet 9 may be more reliably deformed so as to be curved toward the post-transfer guide member 45 and the introduction guide member 54 in the transport direction (FIG. 7B).

As a result, the occurrences of the following situation may be more reliably avoided with the fixing device 5B: that is, the part of the recording sheet 9 (transfer side 91) on the trailing end side not having reached the pressure contact portion FN is brought into contact with (slides against) the outer circumferential surface of the heating roller 51B or the peripheral components 100 disposed upstream of the heating roller 51B in the transport direction of the recording sheet 9 (see FIG. 16).

Accordingly, this fixing device 5B may more reliably suppress the image disturbances (so-called smudging) caused by the contact of part of the transfer side 91 of the recording sheet 9 with the peripheral components 100 disposed upstream of the heating roller 51B in the transport direction of the recording sheet 9, the outer circumferential surface of the heating roller 51B, or the like after the part on the leading end portion 9*a* side of the recording sheet 9 onto which the toner images have been transferred has been introduced into the pressure contact portion FN.

Other Exemplary Embodiments

The cut shape 61 serves as the recessed shape 60 of the introduction guide member 54 according to the first and second exemplary embodiments. However, the form, the dimensions, and the like of the recessed shape 60 are not particularly limited as long as the recessed shape 60 is able to deform the central portion of the recording sheet 9 on the trailing end side not having reached the pressure contact portion FN so as to be recessed relative to both the end portions of the recording sheet 9. Accordingly, the cut shape 61 may be changed to a structure in which, for example, each of the end portions of the central portion 542 has an inclined flat or an inclined curved surface or the entire shape of the cut shape 61 may be changed to a curved shape.

Figure 14A:
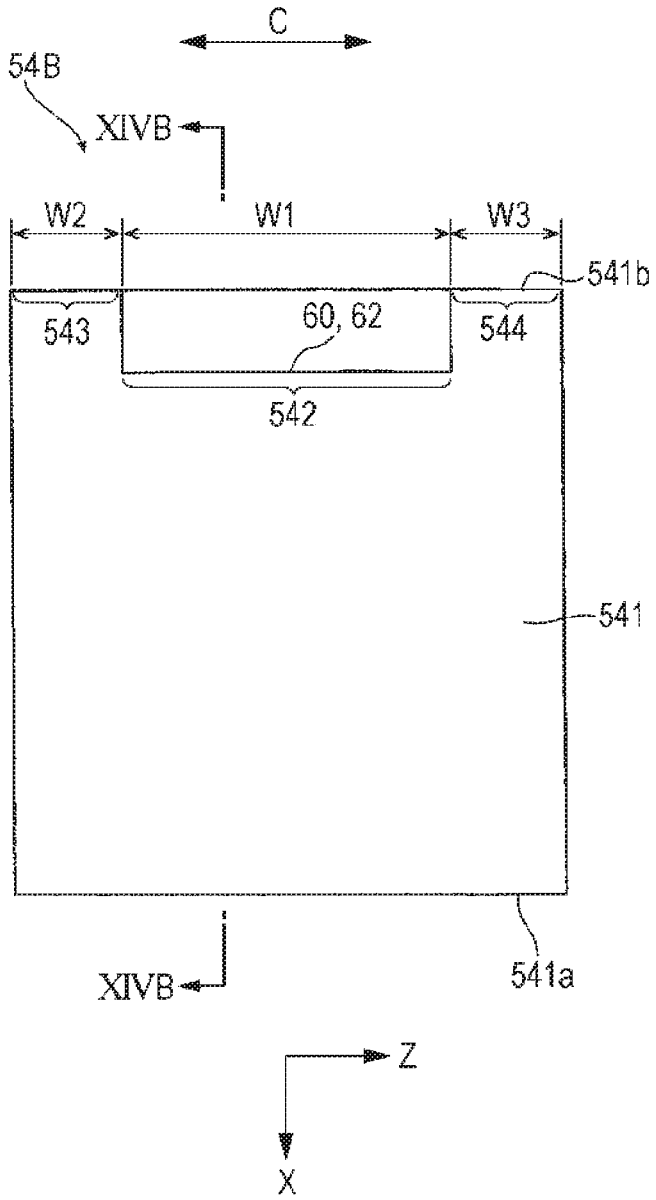
FIGS. 14A and 14B illustrate another structural example of the introduction guide member, and out of FIGS. 14A and 14B.
Figure 14B:
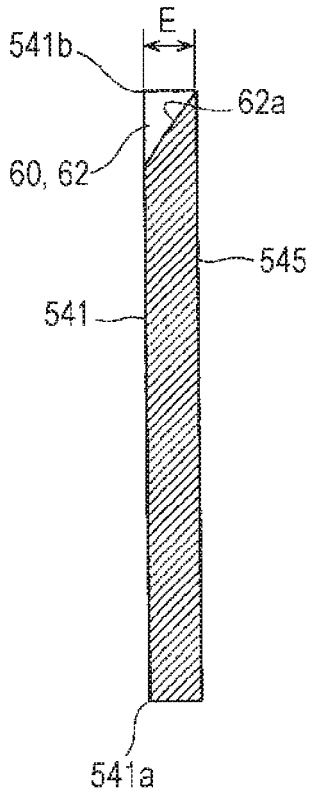

Other examples of the recessed shape 60 may include, for example, as illustrated in FIGS. 14A and 14B, a shape formed by beveling the central portion 542 of the guide ending portion 541*b* of the guide portion 541 of an introduction guide member 54B (beveled shape 62). The beveled shape 62 adopted for the introduction guide member 54B may be formed as follows: that is, the central portion 542 of the guide ending portion 541*b* of the guide portion 541 is beveled so as to form a bevel 62*a* from a specified position closer to the center of the guide portion 541 than the guide ending portion 541*b*, that is, the upstream side in the transport direction of the recording sheet 9, toward a non-guide portion 545 opposite to the guide portion 541. A portion having a largest height difference E (FIG. 14B) between the guide portion 541 and the non-guide portion 545 of this beveled shape 62 is a most recessed portion that is able to deform the central portion of the recording sheet 9 so as to be recessed relative to both the end portions of the recording sheet 9.

Furthermore, although a member having a flat surface (flat plate or the like) as the guide portion 541 is applied to the introduction guide member 54 (54B) according to the first and second exemplary embodiments, this is not particularly limiting. Examples of another introduction guide member 54 include, for example, a plate-shaped base member having a portion including straight ridge forms (ribs) that extend in the transport direction of the recording sheet 9 and are arranged parallel to one another on a surface serving as the guide portion 541. Alternatively, the introduction guide member 54 may include plural plates that extend in the transport direction of the recording sheet 9 and are arranged parallel to one another. In this case, long side portions of the plates extending in the transport direction are collectively used as a single guide portion.

Furthermore, the pressure roller 53 in the form of a roller is applied as the pressure rotary member according to the first and second exemplary embodiments. However, another structure may be applied to the pressure rotary member. Specifically, a pressure rotary member in the form of a belt may be applied.

The pressure rotary member in the form of a belt includes, for example, the following components: an endless rotating belt, a pressure member, a support member, a support structure, and the like. The rotating belt is able to be in contact with and rotated by part of the outer circumferential surface of the heating roller 51 (51B) extending in the rotational axis direction C. The pressure member forms the pressure contact portion FN by pressing the rotating belt against the outer circumferential surface of the heating roller 51 (51B) from an inner circumferential side of the rotating belt. The rotating belt is rotatably supported by the support member. The support structure supports the pressure member in a pressed state. Furthermore, in the case where the heating roller 51B according to the second exemplary embodiment is applied, the pressure member is entirely or partly formed of an elastic material that is elastically deformed so as to follow the shape of the outer circumferential surface of the heating roller 51B when the pressure member is in pressure contact with the heating roller 51B with the rotating belt interposed therebetween.

Furthermore, according to the second exemplary embodiment, the shape of the outer circumferential surface of the heating roller 51B is such that the outer diameter R gradually reduces from the center P1 toward both the ends P2 and P3 in the rotational axis direction C. This shape is formed by processing the surface layer 515 so that the above-described outer diameter R is provided. However, a method of producing the heating roller 51B having the above-described outer diameter R is not limited to this.

Furthermore, the fixing device 5 (5B) is disposed such that the pressure contact portion FN thereof is disposed at a position separated from the pressure contact portion TN of the second transfer portion above the pressure contact portion TN in the gravity direction according to the first and second exemplary embodiments. However, this is not limiting. The fixing device 5 (5B) may be disposed, for example, such that the pressure contact portion FN thereof is disposed at a position separated from the pressure contact portion TN of the second transfer portion in the substantially horizontal direction.

Furthermore, the image forming apparatus to which the exemplary embodiments of the present invention are applied may adopt a so-called side registration method as the transport regulating method. The side registration method regulates the transport of the recording sheet 9 as follows: that is, the recording sheet 9 is transported so that one of end edges in the feed width of the recording sheet 9 passes through a position at one of the end portions of the feed width of the recording sheet transport path. In this case, the fixing device 5 may have a structure with which the recording sheet 9 transported with the side registration method is introduced into the pressure contact portion FN without a change in the state of the recording sheet 9. Alternatively, the fixing device 5 may have a structure (arrangement) with which the central portion of the recording sheet 9 transported with the side registration method, the central portion located at the center in the feed width, passes through a substantially central position of the pressure contact portion FN in the rotational axis direction C.

Furthermore, the image forming apparatus to which the exemplary embodiments of the present invention are applied is not limited to the image forming apparatus 1 exemplified in, for example, the first exemplary embodiment. The image forming apparatus may include, for example, the image forming section 2 that directly transfers toner images from image holding members such as photosensitive drums (onto the recording sheet 9 without using the intermediate transfer device 30) or include the image forming section 2 that forms a monochrome image and transfers the monochrome image onto a recording sheet.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heater;

a heating rotary member that has an outer circumferential surface and that is rotated while being heated by the heater;

a pressure rotary member that is in pressure contact with part of the outer circumferential surface of the heating rotary member extending in an axial direction so as to be rotated and so as to form a pressure contact portion which allows a recording medium having a leading end and lateral end portions and bearing an unfixed image having been transferred thereto to pass therethrough; and a guide member that has a guide portion which guides the leading end of the recording medium toward part of the outer circumferential surface of the heating rotary member approaching the pressure contact portion and which has a guide ending portion where the guiding performed by the guide portion ends and where a central portion and left and right end portions other than the central portion of the guide ending portion in a direction parallel to a rotational axis direction of the heating rotary member are provided, wherein, in the guide member, the central portion has a recessed shape recessed relative to the left and right end portions that guide the lateral end portions of the recording medium while the recording medium is being transported.

2. The fixing device according to claim 1, wherein the recessed shape of the guide member is defined by a cut shape.

3. The fixing device according to claim 2, wherein the heating rotary member includes a roller that has a shape having a center and both ends, and wherein an outer diameter of the heating rotary member gradually reduces from the center to both the ends in the rotational axis direction.

4. The fixing device according to claim 1, wherein the heating rotary member includes a roller that has a shape having a center and both ends, and wherein an outer diameter of the heating rotary member gradually reduces from the center to both the ends in the rotational axis direction.

5. An image forming apparatus comprising:

an image forming section that forms an unfixed image formed of developer and that transfers the unfixed image to a recording medium; and a fixing device that fixes the unfixed image having been transferred to the recording medium by the image forming section, wherein the fixing device is according to claim 1.

* * * * *